US012680308B2

(12) United States Patent
Gonzato

(10) Patent No.: US 12,680,308 B2
(45) Date of Patent: Jul. 14, 2026

(54) DEVICE FOR LOCKING PANELS OR SLABS WITH AN IMPROVED STRUCTURE

(71) Applicant: IND.I.A. S.P.A., Malo (IT)

(72) Inventor: Dario Gonzato, Malo (IT)

(73) Assignee: IND.I.A. S.P.A., Malo (IT)

( * ) Notice: Subject to any disclaimer, the term of this patent is extended or adjusted under 35 U.S.C. 154(b) by 225 days.

(21) Appl. No.: 18/509,392

(22) Filed: Nov. 15, 2023

(65) Prior Publication Data

US 2024/0191511 A1 Jun. 13, 2024

(30) Foreign Application Priority Data

Nov. 15, 2022 (IT) ..... 102022000023472

(51) Int. Cl.
*E04F 11/18* (2006.01)

(52) U.S. Cl.
CPC ..... *E04F 11/1812* (2013.01); *E04F 11/1853* (2013.01)

(58) Field of Classification Search
CPC ..... E04C 2003/0439; E04C 2003/0473; E04F 11/1812; E04F 11/1851; E04F 11/1853; E04F 2011/1823; E04F 2011/1825; E04F 2011/1829; E04F 2011/1831; E04H 17/16; E04H 17/1602; Y10T 403/7062; Y10T 403/7064
USPC ..... 256/24, 31; 403/373, 374.1
See application file for complete search history.

(56) References Cited

U.S. PATENT DOCUMENTS

| | | | | |
|---|---|---|---|---|
| 7,634,891 | B2 * | 12/2009 | Fanucci | E04C 3/30 52/843 |
| 8,826,615 | B2 * | 9/2014 | Feigl | E04F 11/1851 256/24 |
| 9,657,760 | B2 * | 5/2017 | Giacometti | E04F 11/1853 |
| 10,697,170 | B1 * | 6/2020 | Mazzola Vernengo | E04F 11/1853 |
| 10,934,743 | B2 * | 3/2021 | Sprague | E04F 11/1853 |
| 11,686,102 | B2 * | 6/2023 | Sprague | E04F 11/1853 256/65.14 |
| 2006/0070340 | A1 | 4/2006 | Fanucci | |
| 2023/0313524 | A1 * | 10/2023 | Oakes | E04F 11/1853 52/704 |

FOREIGN PATENT DOCUMENTS

| | | | | |
|---|---|---|---|---|
| DE | 102006028766 | A1 * | 12/2007 | E04F 11/1851 |
| DE | 102009008307 | A1 * | 10/2009 | E04F 11/1851 |
| DE | 102018009461 | A1 * | 6/2020 | E04F 11/1853 |
| EP | 2896764 | A1 * | 7/2015 | E04F 11/1853 |
| EP | 3009580 | A1 * | 4/2016 | E04F 11/1853 |

(Continued)

OTHER PUBLICATIONS

Rapporto di Ricerca e Opinione Scritta [Search Report and Written Opinion] Dated Jun. 8, 2023 From the Ministero Dello Sviluppo Economico, Direzione Generale Sviluppo Produttivo e Competitivita, Ufficio Italiano Brevetti e Marchi Re. Application No. IT202200023472. (10 Pages).

*Primary Examiner* — Josh Skroupa

(57) ABSTRACT

A device (10) for clamping panels and sheets comprises an extruded U-shaped profile. The profile comprises a base box (12) and first and second brackets (11) extending transversely from the base box. A plurality of polygonal slots (20) are formed within the brackets (11) and the base box (12). At least one of the slots (20) is filled with an additional material, such as an expansive cement mortar.

9 Claims, 18 Drawing Sheets

(56) References Cited

FOREIGN PATENT DOCUMENTS

| | | | | | |
|---|---|---|---|---|---|
| EP | 3179007 | | 6/2017 | | |
| EP | 3179007 | A1 * | 6/2017 | ..... | E04F 11/1853 |
| EP | 2905514 | B1 * | 6/2018 | ..... | E04F 11/1853 |
| EP | 3742003 | A1 * | 11/2020 | ..... | E04F 11/1817 |
| EP | 3303727 | B1 * | 9/2021 | ..... | E04F 11/1812 |
| FR | 3088662 | A1 * | 5/2020 | ..... | E04F 11/181 |
| IT | 201900020898 | | 5/2021 | | |
| WO | WO-2018111208 | A1 * | 6/2018 | ..... | E04F 11/1853 |

* cited by examiner

DEVICE FOR LOCKING PANELS OR SLABS WITH AN IMPROVED STRUCTURE

RELATED APPLICATION

This application claims the benefit of priority of Italy Patent Application No. 102022000023472 filed on Nov. 15, 2022, the contents of which are incorporated by reference as if fully set forth herein in their entirety.

FIELD AND BACKGROUND OF THE INVENTION

The present invention relates generically to a device for clamping panels or sheets, for example for the construction of balustrades, parapets, railings, or other fencing elements, with an improved structure.

For the structural connection of glass panels or sheets to building structures, such as, for example, reinforced concrete slabs or floors requiring safety parapets, the use of metal profiles (made of steel or aluminium), which are anchored to the building structure and which in turn hold the panels at an edge through fixing means, is still well known.

However, this type of clamping devices is made of noble materials, such as, for example, aluminium, thus proving very costly and poorly resistant in relation to the loads they must withstand, as the material used has low deformation resistance.

One problem of the prior art lies in the fact that, when mounted, the clamping device and thus the material making it up, for example aluminium, will be in direct contact with the floor and, due to its physical characteristics, will deform with great ease, with the related problems ensuing therefrom.

Moreover, one should likewise take into consideration the fact that, though glass sheets of increasingly large dimensions are requested, it is desired that the supporting metal profiles be of increasingly reduced dimensions and be as unobtrusive as possible, in order not to impact negatively on the aesthetic continuity of the installations and in order to reduce costs.

This requirement gives rise, on the other hand, to a lower reliability of the clamping device, which should however assure a given resistance.

Furthermore, today, in order to overcome the above-described problems given by the use of noble materials, among the various alternatives, the sheets are secured by means of concrete castings or, alternatively, through the use of precast concrete profiles, which, however, have the defect of being subject to the creation of cracks on their surface, making the system unsuitable for bearing the required loads over time. What has just been said also leads to products that are generally very bulky in size.

Moreover, some of these solutions do not allow a replacement of the fixed sheets should this be necessary and require a perimeter demolition of the system and restoration following the replacement.

SUMMARY OF THE INVENTION

The aim of the present invention is thus to overcome the abovementioned drawbacks and, in particular, to provide a device for clamping panels or sheets, with an improved structure, which has a greater resistance compared to the devices of the prior art, both to substantial operating loads of a static type and impact loads of a dynamic type.

Another aim of the invention is to provide a clamping device with an improved structure which renders the system more lightweight and enables the attainment of excellent performances, such as, solely by way of example, high adhesion and resistance to fatigue phenomena, thermal cycles, and high temperatures.

A further aim of the present invention is to provide a clamping device that is more economical compared to the prior art solutions, is simple to install and can be applied on any type of panel or sheet, while also preserving the aesthetic continuity of installations built with several glass sheets side by side.

These and other aims are achieved by a device for clamping panels or sheets, with an improved structure, according to the appended claim 1, while other detailed technical features of the clamping device which is the object of the invention are disclosed in the subsequent dependent claims.

Therefore, the object of the present invention is a device for clamping panels and sheets, comprising an extruded profile having a U-shaped profile.

Advantageously, the device is inferiorly attachable to a reference surface and is adapted to house at least one panel or sheet within the U. In preferred but non-limiting embodiments, the sheet is usually single-glazed, laminated and treated according to the required resistance. Furthermore, the sheet can also be made of a composite material such as (HPL), which is a type of decorative laminate consisting of numerous layers of Kraft paper impregnated with thermosetting resins, or materials of a composite type.

Advantageously, the aforesaid profile comprises:

- a first and a second bracket respectively comprising an inner wall and an outer wall adapted to act as upright members, as well as a plurality of further horizontal inner walls located between the inner wall and the outer wall, so as to act as cross members;
- a base box to which the first and second brackets are transversely fixed in a direction exiting from the base box;
- a plurality of slots which are formed within the first and second brackets and the base box, with a substantially polygonal cross-section.

In a first non-limiting embodiment, the slots are quadrangular in shape and said first and second brackets are parallel to each other.

In further embodiments, such as the one that may be seen in FIGS. 5A, 5B and 5C, the aforesaid slots have a substantially triangular shape and/or an irregular geometry. In particular, said triangular slots are preferably made on the left side of the profile in question, i.e., the one facing towards the inside of the structure.

Advantageously, the device is made of a noble material, preferably aluminium.

Furthermore, at least one slot of the plurality of slots, preferably in the first and second brackets, is filled with a further material, so as to create a device of the hybrid type and which will increase the overall performances of the device in question.

Likewise advantageously, as an alternative to what was said above, it is possible for the entire plurality of slots to be filled with the further material.

Solely by way of non-limiting example, the aforesaid injectable material in the plurality of slots is a material to be chosen preferably between an expansive premixed cement mortar for anchoring centimetric thicknesses by casting which is of a commercial type or a cement mortar or a cement mortar of an expansive type or a two-component resin, preferably vinylester.

In greater detail, the injectable material is filled into the slots by means of the casting technique for centimetric thicknesses, but also through injection under pressure with the aid of compressors and delivery nozzles.

In preferred but non-limiting embodiments, the inner walls of the device penetrate perpendicularly into the base so as to optimize the load distribution, as well as the durability and resistance of the device.

Solely by way of example, the base has a thickness of 3.5 mm, again in order to achieve the aim proposed above.

Moreover, each inner wall, outer wall and further inner wall is substantially flat and smooth or comprises knurls and/or protrusions to increase the friction between the walls and better strengthen the union between the noble perimeter profile and cement filler material, for example aluminium, and the expansive premixed cement mortar for anchoring centimetric thicknesses by casting injected therein.

BRIEF DESCRIPTION OF THE SEVERAL VIEWS OF THE DRAWINGS

Further aims and advantages of the present invention will emerge more clearly from the description that follows, which relates to a preferred but non-limiting example embodiment of the clamping device according to the invention, as well as from the appended drawings, wherein.

DESCRIPTION OF SPECIFIC EMBODIMENTS OF THE INVENTION

Figure 1:
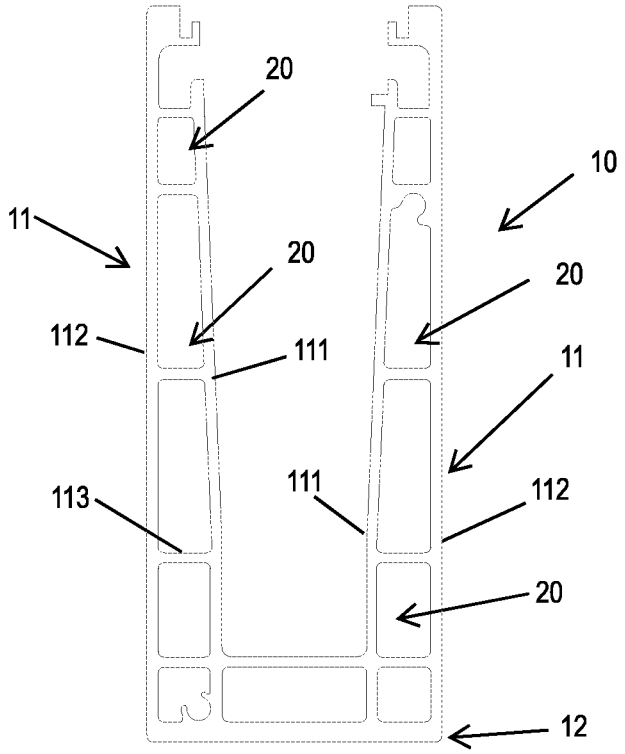
FIG. 1 shows a first embodiment of the device with an improved structure, according to the present invention.

With reference to the mentioned figures, 10 indicates an extruded clamping device, having a U-shaped profile, adapted to be attached inferiorly to a reference surface, such as a slab and/or a floor, and to house a panel or sheet not shown in the figures, preferably made of glass, for the construction of balustrades, parapets, railings, and fencing structures in general.

Advantageously, the clamping device 10, U-shaped, has a substantially closed structure, comprising:

- a first and a second bracket, which are indicated by the numerical reference 11 in the figures;
- a base box 12, relative to which the aforesaid brackets are substantially transversely fixed in a direction exiting therefrom;
- a plurality of substantially polygonal shaped slots 20 formed within the first and second brackets 11 and the base box 12.

In greater detail, each first and second bracket 11 comprises a respective inner wall 111 and a respective outer wall 112 adapted to act structurally as upright members, as well as a plurality of further horizontal inner walls 113, located substantially parallel to the ground and between the inner wall 111 and the outer wall 112, so as to act structurally as cross members.

Advantageously, the aforesaid slots 20 are delimited by the inner walls 111 and the outer walls 112 of each bracket 11, as well as by the horizontal inner walls 113.

In a first embodiment, the slots 20 have a quadrangular shape and said first and second brackets 11 are structurally parallel to each other.

Figure 5A:
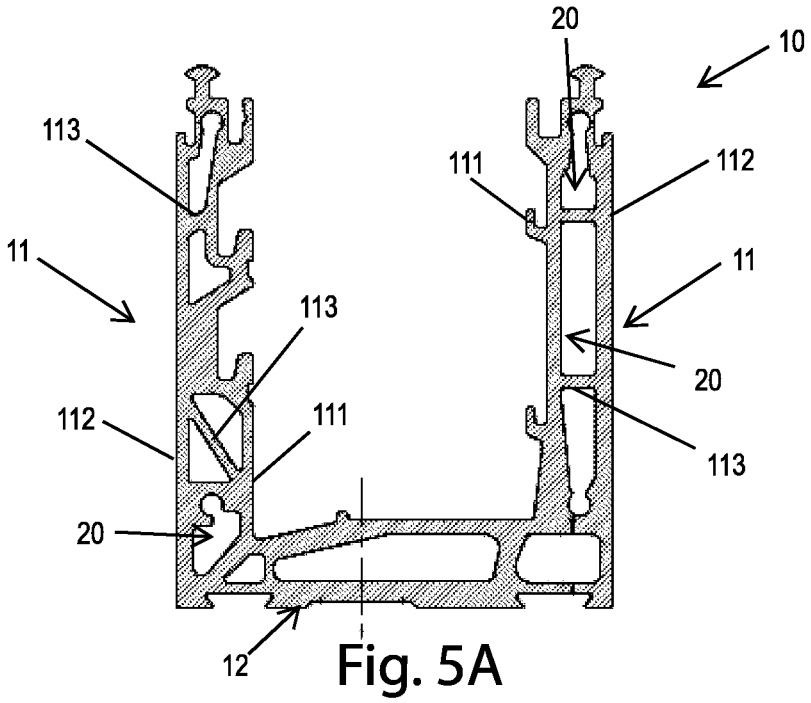
FIGS. 5A, 5B and 5C show a fourth and a fifth embodiment of the device with an improved structure according to the present invention.
Figure 5B:
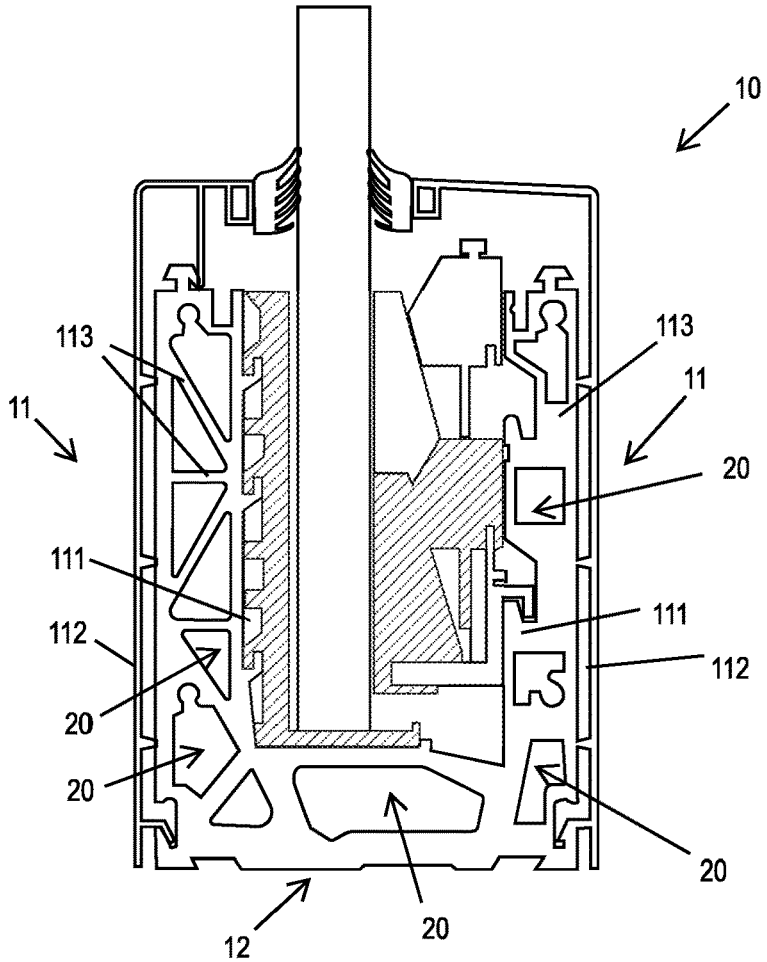
Figure 5C:
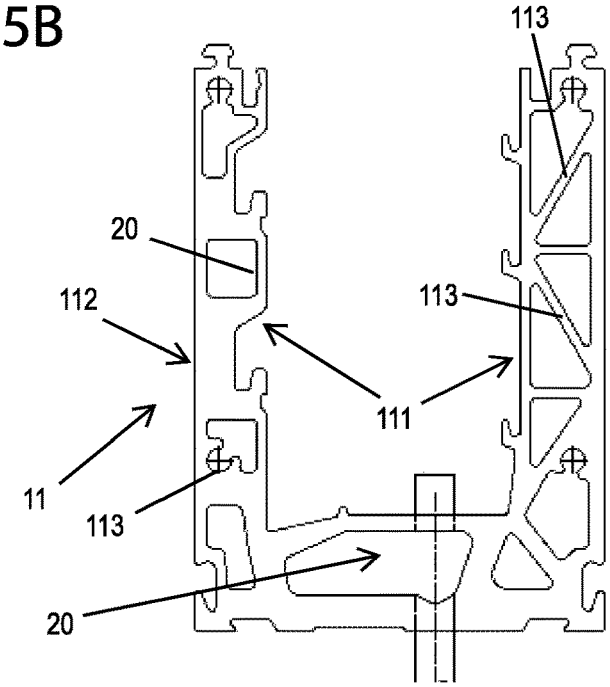

In further embodiments, such as the one that may be seen in FIGS. 5A, 5B and 5C, the aforesaid slots 20 have a substantially triangular shape and/or an irregular geometry. In particular, the triangular slots 20 are preferably made on the left side of the profile of the present invention, i.e., the one facing towards the inside of the structure.

According to the present invention, compared to the device 100 of the prior art, the device with an improved structure 10 has a larger thickness of the base 12 compared to the thickness used today. Solely by way of example, the thickness of the base 12 of the device of prior art (FIG. 2A) has 3.5 mm, 2.0 mm, and 2.7 mm portions, whereas that of the solution given by the present invention has a substantially constant thickness of 3.5 mm.

Furthermore, again advantageously, the inner walls 111 enter perpendicularly into the base 12 and have a greater thickness compared to that present in the prior art. Again with reference to FIGS. 2A and 2B, in the solution of a known type 100, in the base box 12 the inner walls are off-axis relative to the inner walls of the brackets 11 and with a thickness of about 1.8 mm, rather than the 2 mm of the present solution.

Advantageously, the device 10 is placed directly on the ground and fixed thereto by means of an associated anchorage system, also called anchor bolt.

Physically, the behaviour of the first and second brackets 11, being subject to bending, when in use, is that of a Vierendeel truss, which will be better described below.

Compared to the prior art, the device 10, as structured, assures that the thicknesses of the device are optimized compared to the distribution thereof in the device of the prior art. In fact, there is no need to have a full device 10, but it is sufficient that the latter has the aforesaid slots, which structurally allow the thickness and thus, accordingly, the weight of the device 10 to be reduced, thereby optimizing the use of the material making it up.

Figure 2A:
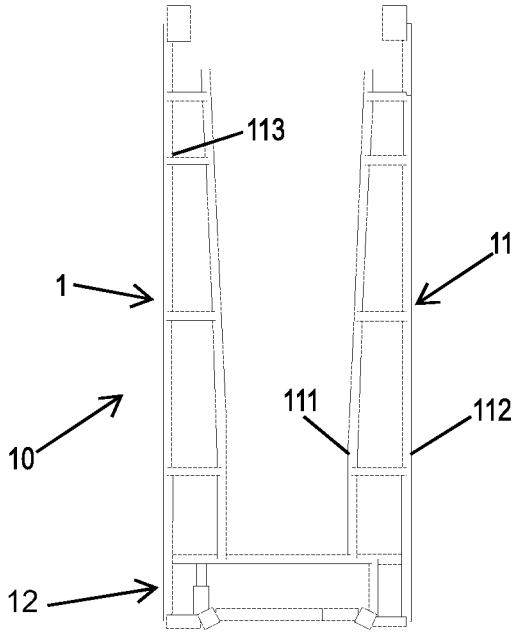
FIGS. 2A-2B relate to the difference in thickness between the geometry of devices of the prior art and the new geometry in FIG. 1.
Figure 2B:
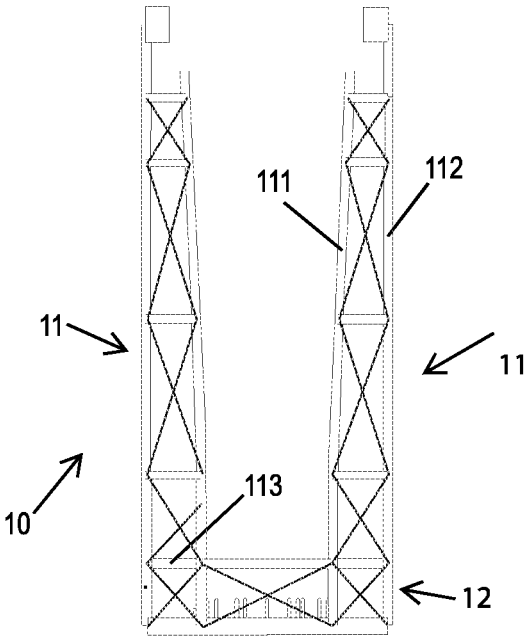

In greater detail, FIGS. 2A and 2B indicate the difference in the thickness of the material and the distribution thereof for the construction of the device 10 of the prior art (FIG. 2A), compared to the one described in the present invention (FIG. 2B).

In preferred but non-limiting embodiments, the material used to make the profile of the device 10 is aluminium. Advantageously, in order to be able to improve the performances of the device 10, the profile thereof is injected with a further material, at least at the level of the brackets 11, thereby creating a profile of a hybrid type.

Advantageously, this hybrid structure avoids problems such as cracking, endowing the device with greater resistance compared to what occurs today with devices of the traditional type.

Solely by way of example, the injectable material inside the profile of the device 10 can be cement mortar, for example of the expansive type, or a two-component resin such as high-performance vinylester and the like, preferably the product commercially known as an expansive premixed cement mortar for anchoring centimetric thicknesses by casting.

Such materials are applicable by casting for centimetric thicknesses and are adapted to endow the device 10 with important characteristics such as high adhesion and resistance to fatigue phenomena, thermal cycles, and high temperatures.

Furthermore, by virtue of the cooperation between the two materials, the one of the profile plus the injected one, there is also an increased possibility of the device 10 withstanding substantial operating loads, for example, 2 kN/m loads of a static type and impact loads of a dynamic type.

In the first embodiment, which may be seen in FIG. 1, the profile has inner walls 111 and outer walls 112 that are substantially flat, smooth, and parallel to each other, and the same applies for the further inner wall 113 (cross member).

Figure 3:
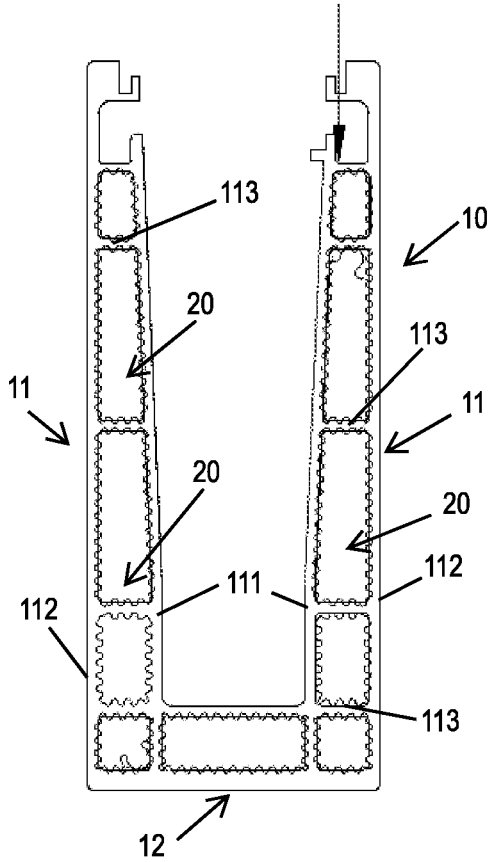
FIG. 3 shows a second embodiment of the device with an improved structure according to the present invention.
Figure 4:
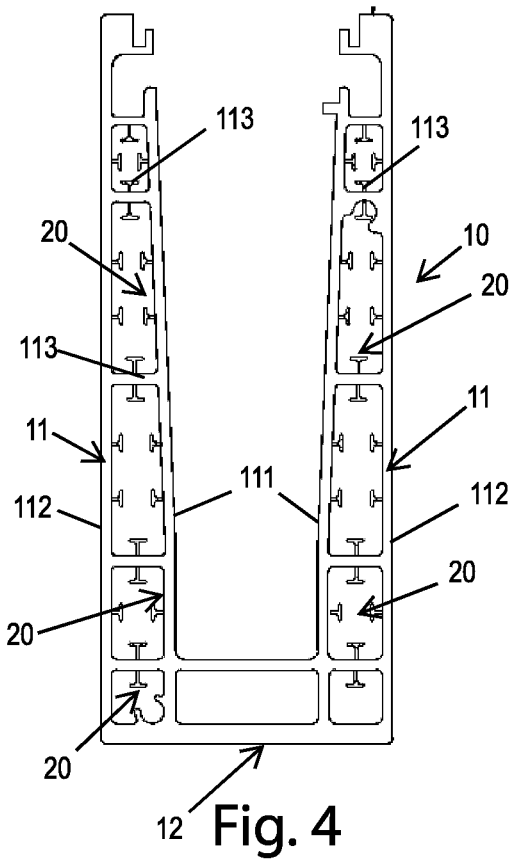
FIG. 4 shows a third embodiment of the device with an improved structure according to the present invention.

In further embodiments, as may be seen in FIGS. 3-5, the inner wall 111, the outer wall 112 and the further plurality of inner walls 113 of those embodiments have knurls (FIG. 3) and/or protrusions of a different type (FIGS. 4 and 5), so as to increase friction and facilitate the grip between the material of the profile of the device 10, for example aluminium, and the product injected therein, for example expansive premixed cement mortar for anchoring centimetric thicknesses by casting.

All the various experimental phases, which, starting from the prior art solution, led to the making of the device with an improved structure 10, the object of the present invention and as described above, will be illustrated in detail below.

Substantially, starting from the study of loads and of the usable material, a first model 100 was constructed, according to the known geometry, which took account of the nonlinear behaviour due to both the geometry of the device and the material used.

For all the study hypotheses of solutions, the control criteria followed were:

- the deformability of the tip of the bracket towards the outside, at the serviceability limit states limited to 3 mm;
- the deformability of the tip of the bracket towards the outside, at the ultimate limit states limited to 5 mm;
- the maximum plastic deformation limited to 5%.

At this point, one began with increases in the thickness of the walls 11, which were made incrementally in small steps of 0.25 mm until the aforesaid verification criteria were met.

Figure 6A:
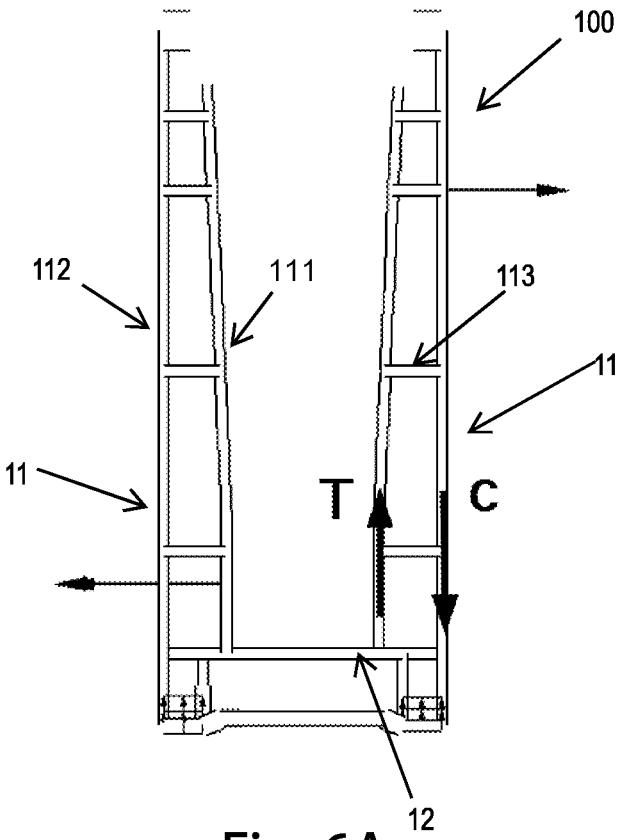
FIG. 6A relates to an embodiment of the clamping device used today, wherein the distribution of forces acting thereon is schematically illustrated.
Figure 6B:
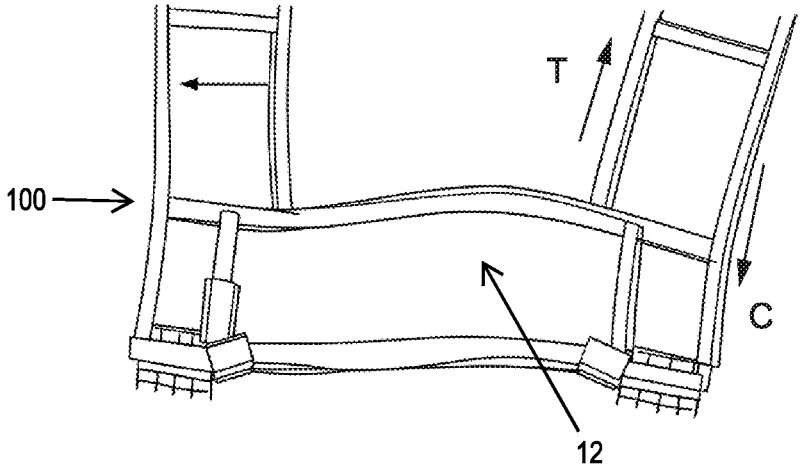
FIG. 6B relates to a reproduction of the stresses acting upon the device of the prior art represented in FIG. 6A.

As may be seen in FIGS. 6A and 6B, relating to the solution of the original type, the critical points of this type of device can be summed up as being at the base thereof and in the upper bracket.

As mentioned previously, the behaviour of the bracket subject to bending is that of a Vierendeel truss.

Generically, the static Vierendeel scheme involves bending and axial action on the upright members (inner wall 111 and outer wall 112) and bending on the horizontal members (further inner wall 113).

The bending moment is broken down as a pair of forces on the vertical walls of the bracket:

T=tensile force

C=compression force

The compression force C, which passes along the outer wall 112, is released directly onto the supporting base due to the direct contact between the device 10 and the ground, whereas the tensile force T must be taken up with some mechanism in order to arrive at the anchorage system (anchor bolt working under tension).

As may be seen in FIG. 6B, the inner vertical wall 111 is in continuity with the upper wall of the base box 12 and hence the tensile force T must necessarily be taken up as bending by the upper wall of the base 12.

Figure 7A:
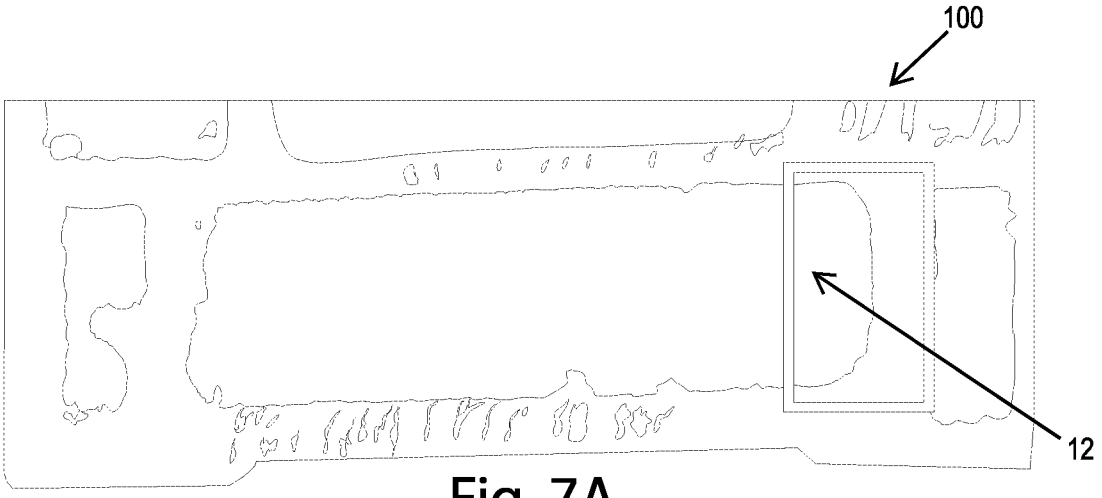
FIGS. 7A-7C show study solutions for optimizing the structure of the device in FIG. 6A so as to eliminate the bending of that known device due to the tensile force.
Figure 7B:
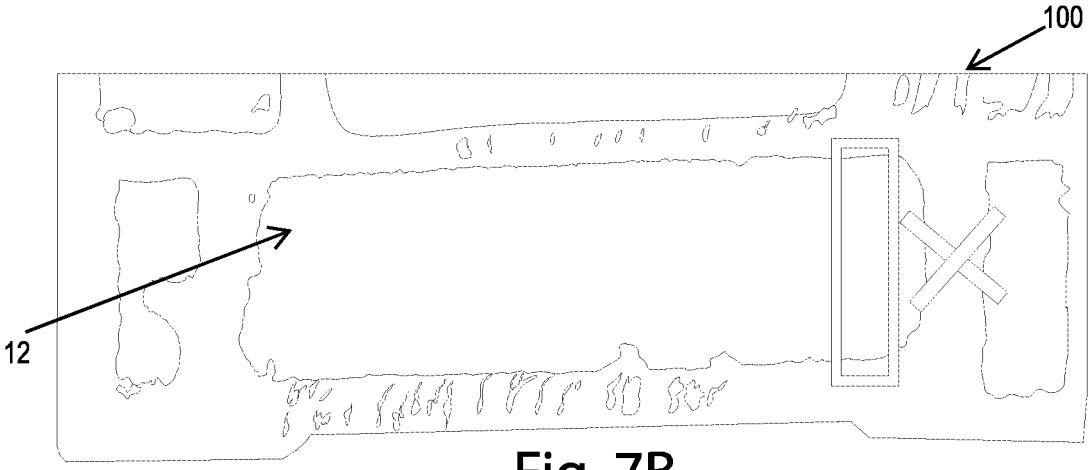
Figure 7C:
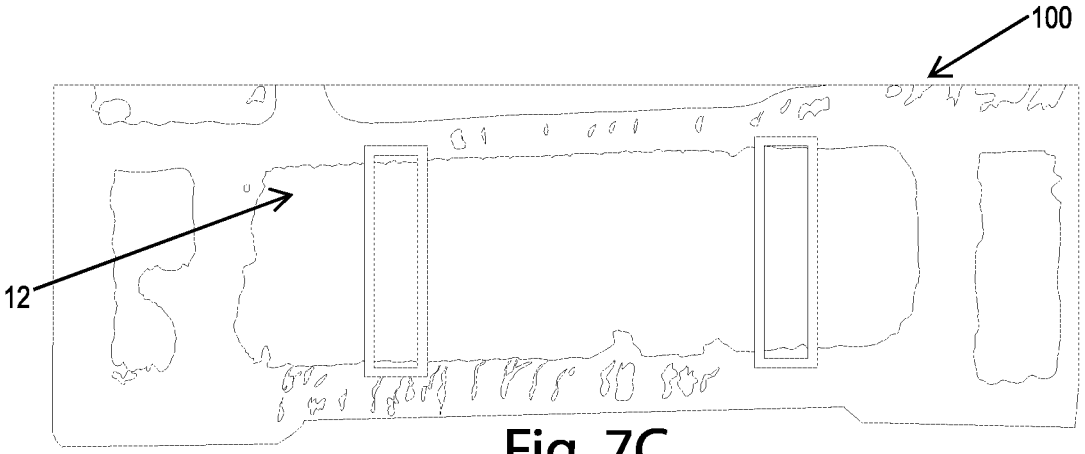

In FIGS. 7A, 7B and 7C one may see the study solutions having the objective of eliminating the bending due to the bending T on the upper part of the base 12 of the device 100 of the prior art.

In a first solution, which may be seen in FIG. 7A, it was attempted to increase the thickness of the wall of the existing base 12, to arrive flush with the inner wall 111 of the bracket 11.

In a second solution, which may be seen in FIG. 7B, it was attempted to actually move the vertical wall of the base 12 at the inner wall 111 of the bracket 11.

In the last solution, which may be seen in FIG. 7C, two vertical walls were added in the base 12 of the device 100. This study solution has the advantage of not modifying the existing vertical walls and of stiffening the base box 12, though it requires milling the two additional walls in the base 12.

Figure 8A:
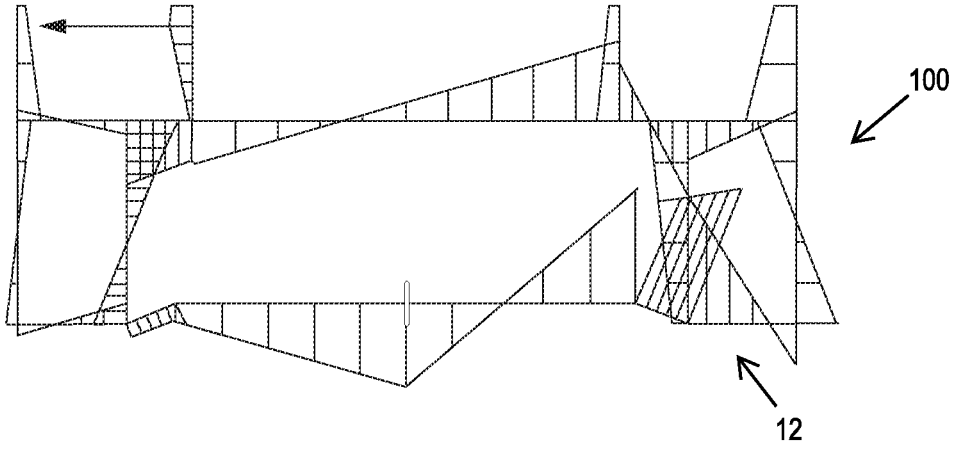
FIGS. 8A-8B are further schematic illustrations of the bending moments acting upon the device in relation to the problem of the Vierendeel truss.

As may be seen in FIG. 8A, in all the above proposals (FIGS. 7A-7C), however, the tensile force must be transferred, by bending, to the base wall 12 in contact with the anchor bolt and, therefore, the base wall 12 must in turn be increased in thickness, in particular in the first and second solutions. The most critical zone is the one around the anchor bolt. Another problem regards the base 12, wherein, in addition to the tensile force T exerted by the bracket 11, it presents bending moments of continuity due both to the Vierendeel-like behaviour of the bracket and the tensile force T.

Figure 8B:
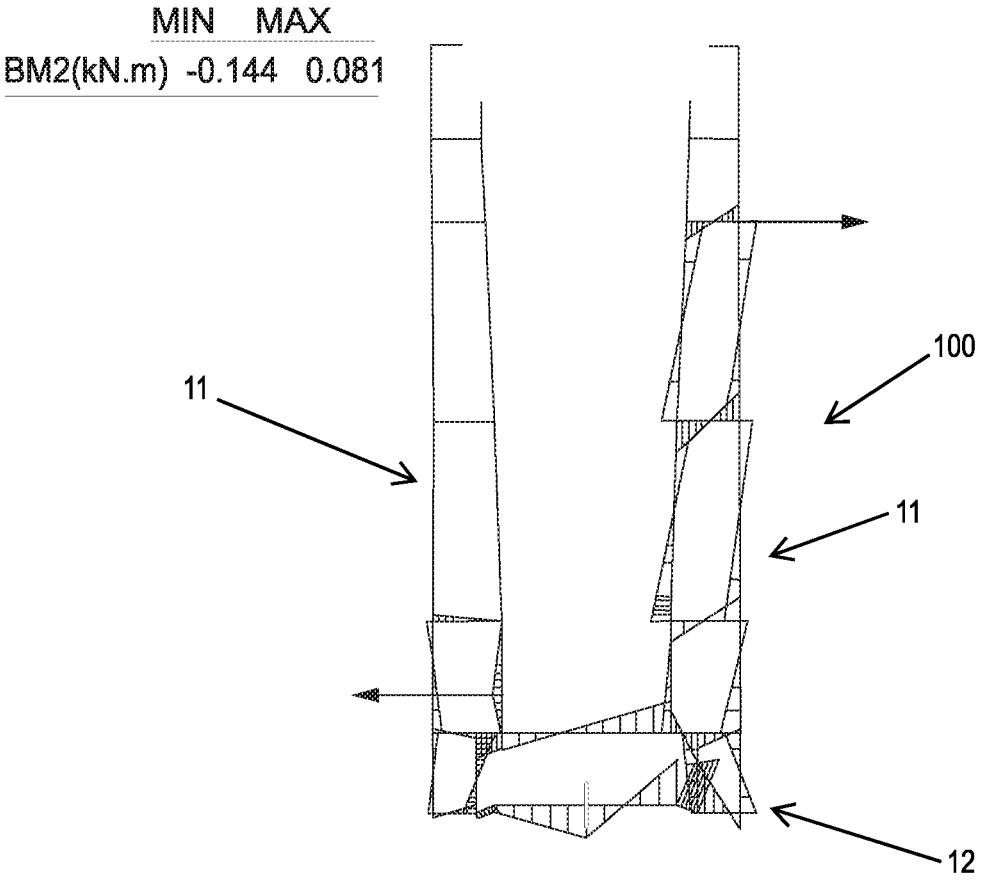
Figure 8C:
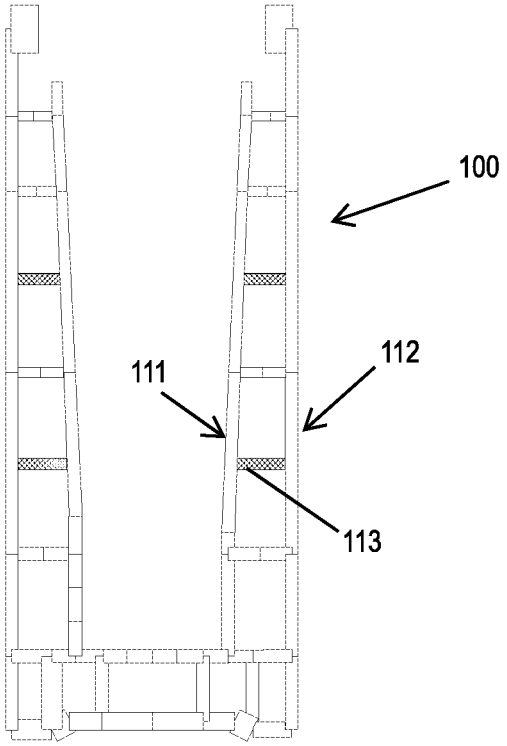
FIGS. 8C and 8D show respective study solutions for the problem schematically illustrated in FIG. 8B.
Figure 8D:
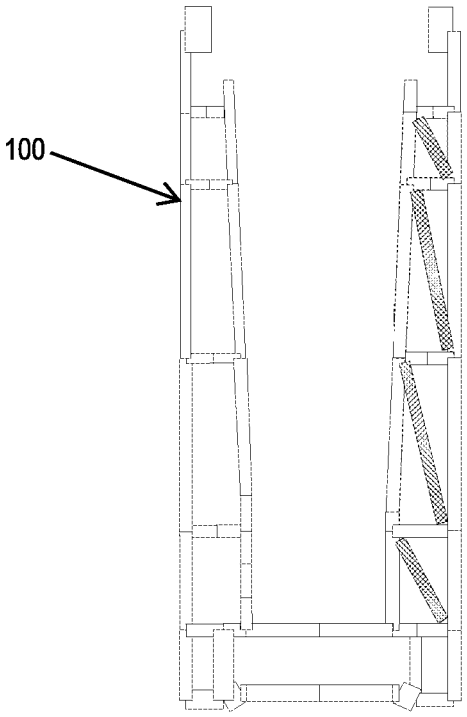
Figure 9A:
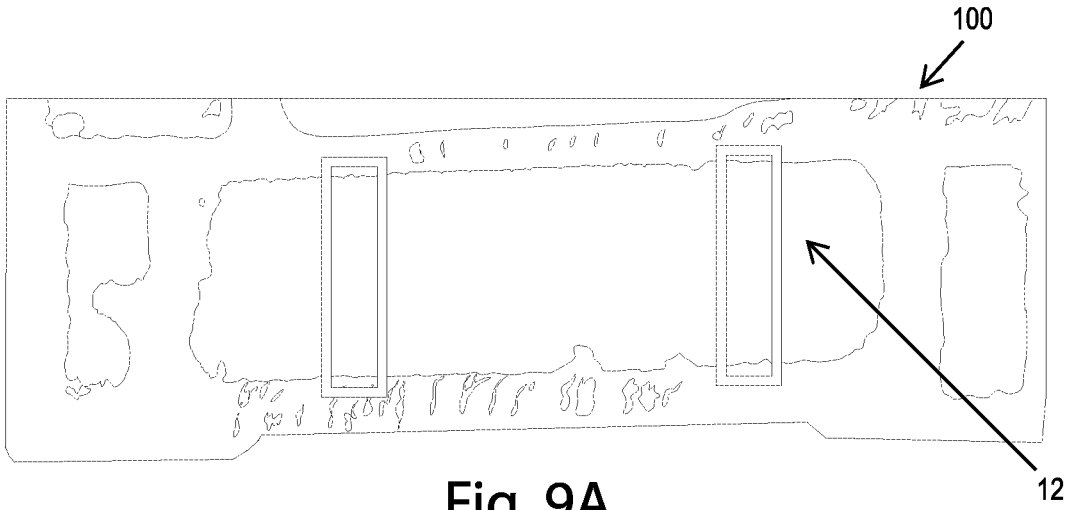
FIGS. 9A and 9B relate to a further study hypothesis for reinforcing the device of the prior art, respectively through the introduction of additional lower walls and an increase in the thickness of the device.
Figure 9B:
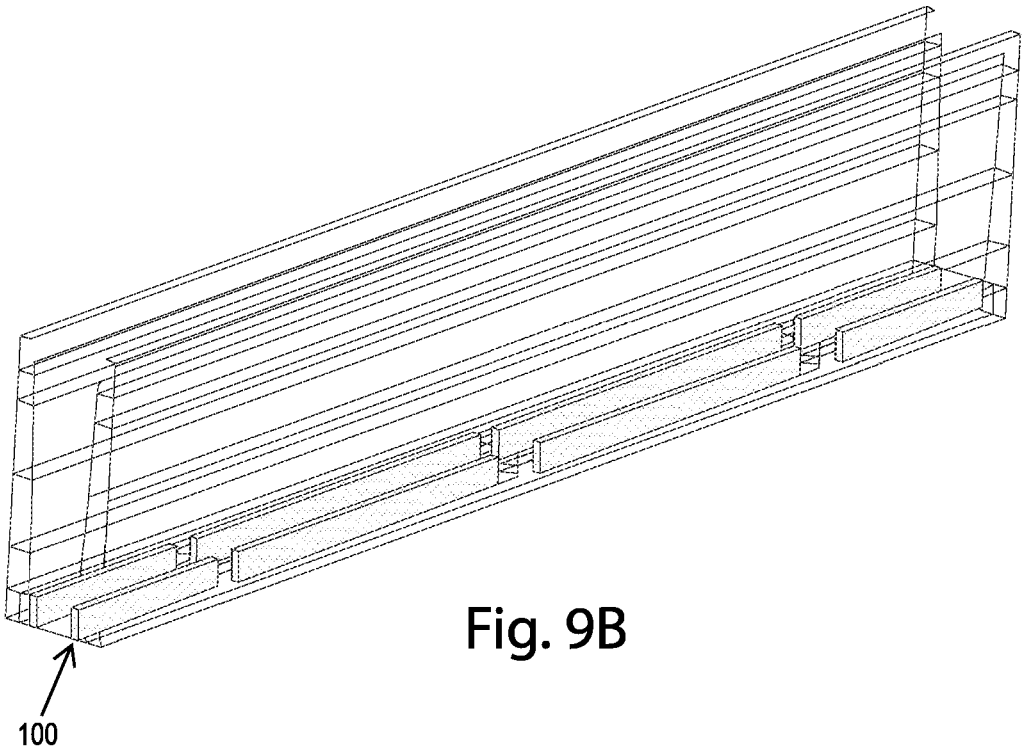
Figure 10A:
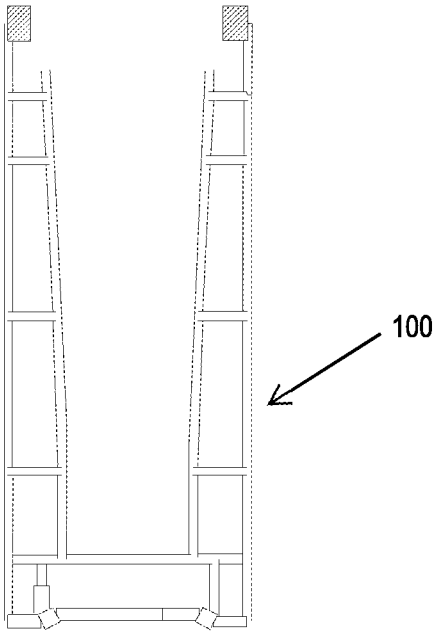
FIGS. 10A-10D are of the schematic views relating to the difference in thickness between the original geometry of the device and that of the new geometry, with a rendering of the latter.
Figure 10B:
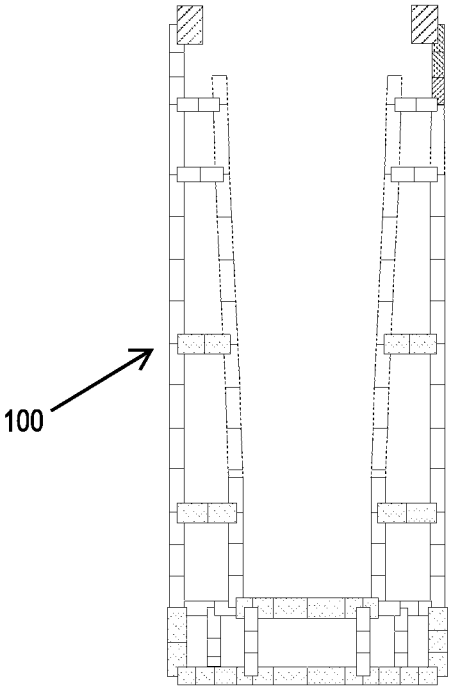
Figure 10C:
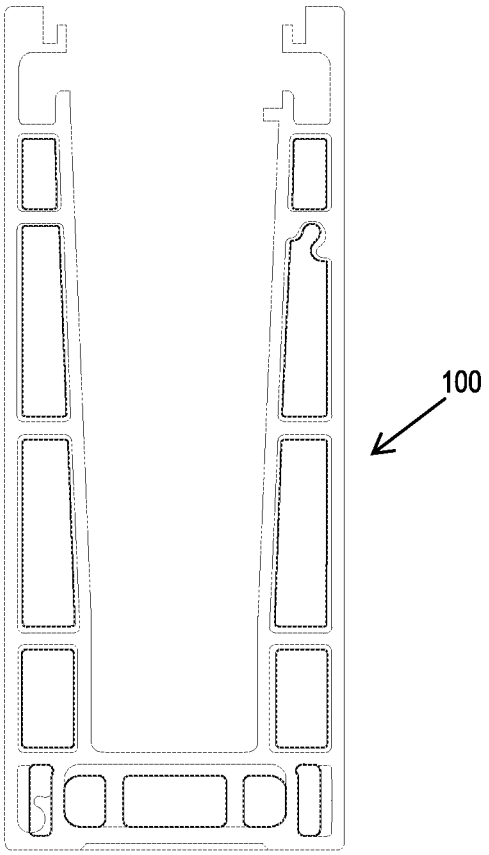
Figure 10D:
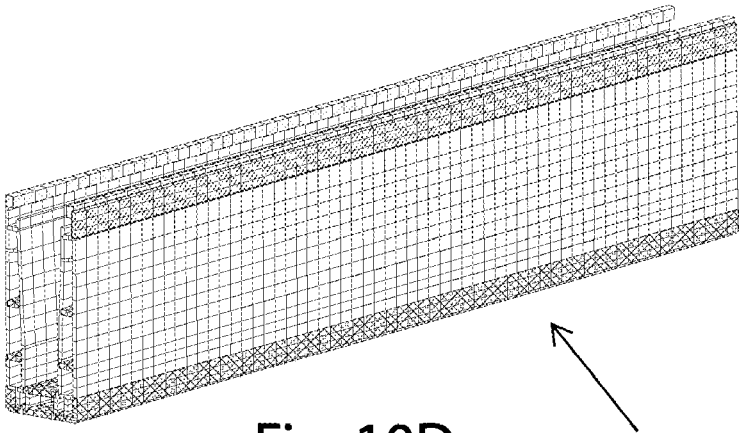

With reference to FIG. 8B, and as explained up to this moment, the bracket 11 works like a Vierendeel truss. This means that in the vertical walls 111 and 112 there is local bending, in addition to the axial actions due to the bending moment. The local bending gives a large contribution to the stress state, as the thickness of the walls 111 and 112 is very small. The possible strategies for improving the stress (and deformation) state are:

To increase the thicknesses of the walls 111, 112 and 113;

To add further cross members 113 parallel to the already existing ones (FIG. 8C);

To add diagonals: either made of aluminium or generated by the introduction of the high-resistance expansive premixed cement mortar for anchoring centimetric thicknesses by casting (FIG. 8D). In the latter case the diagonals can work only under compression At this point, as may be seen in FIGS. 9A and 9B, experimentation was carried out on the first reinforcement hypothesis, which proposed the introduction of two additional lower walls in the base 12, increasing the thickness where necessary, until meeting the previously stated verification criterion. The results compared with the traditional solution may be seen in FIGS. 10A-10D.

Figure 11A:
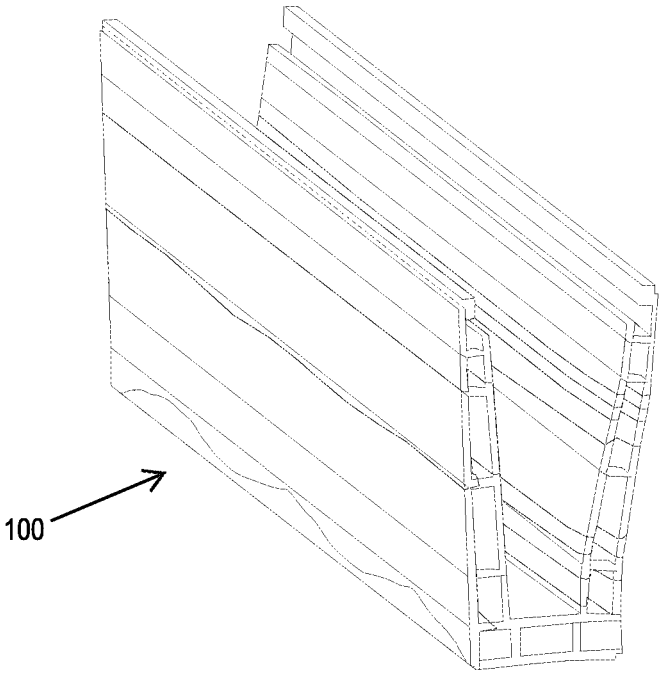
FIGS. 11A-11E represent the schematic results of the displacement of the device to the serviceability limit state and ultimate limit state, with different load multipliers, in relation to the study solution with the new geometry in FIG. 10B, FIGS. 12A-12B show a further study hypothesis for reinforcing the device of the prior art, respectively through the introduction of expansive premixed cement mortar for anchoring centimetric thicknesses by casting into the device, leaving the geometry of the prior art solution.
Figure 11B:
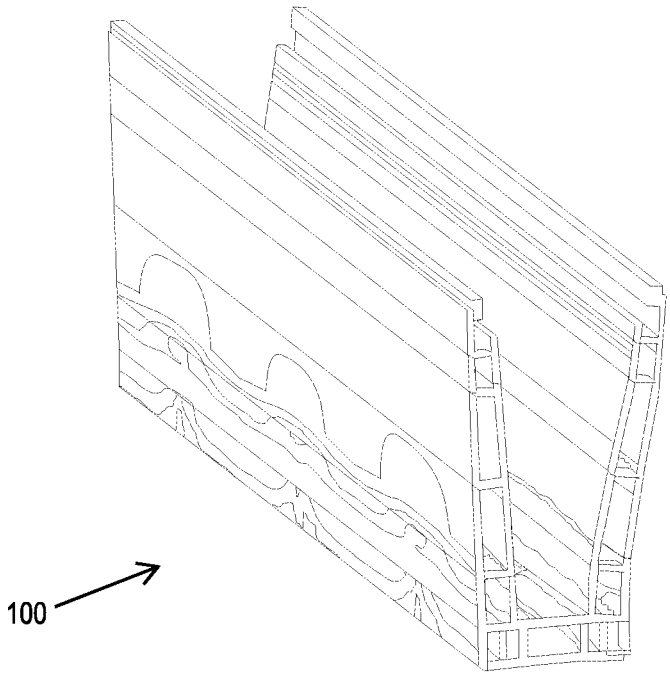

FIGS. 11A-11B show the results of the structure of the device 100 at the serviceability limit state, with a load multiplier equal to 1. In particular, FIG. 11A relates to the displacements at the serviceability limit state, according to an ascending scale of displacement in mm, while FIG. 11B relates to stress at the serviceability limit state in an ascending scale calculated in Mpa.

Figure 11C:
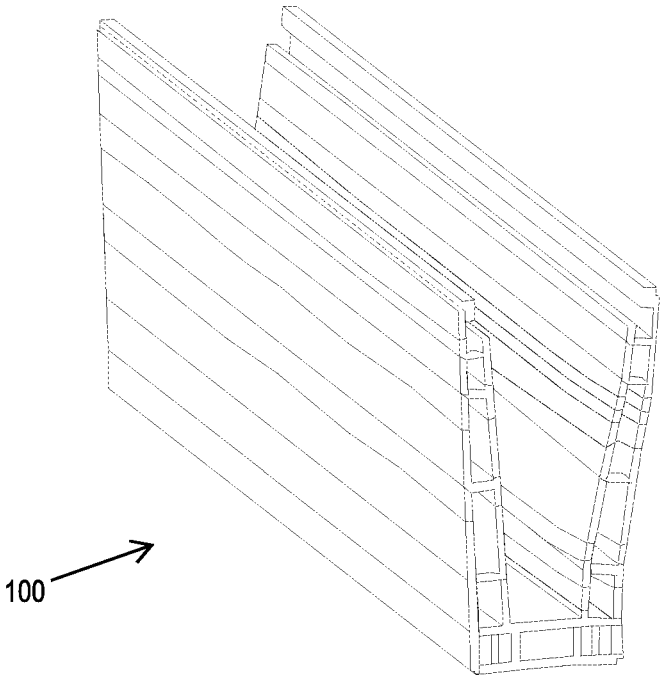
Figure 11D:
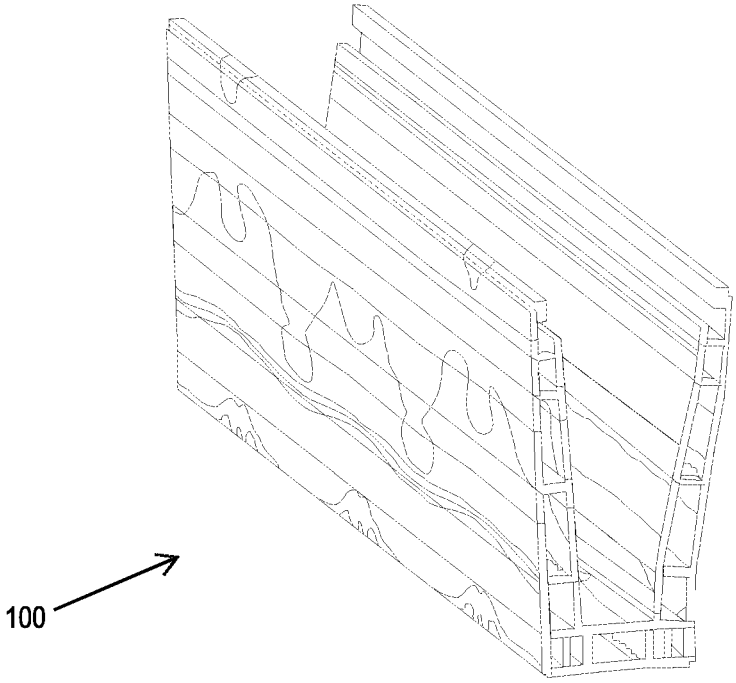
Figure 11E:
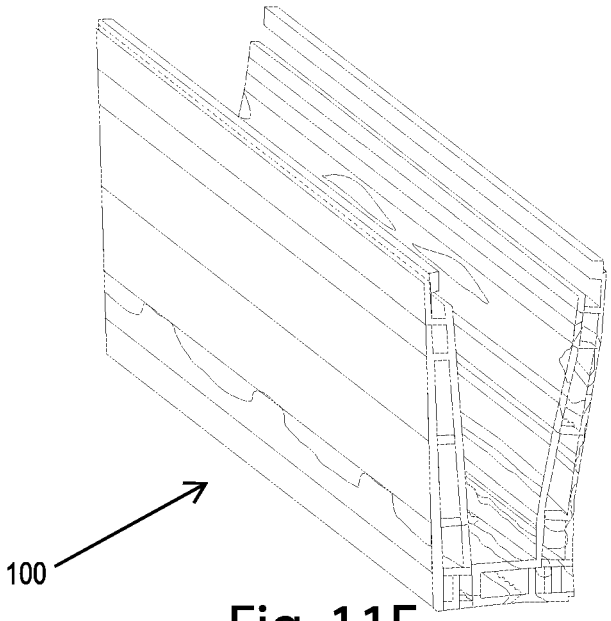

FIGS. 11C-11E show the results at the ultimate state with a load multiplier equal to 1.50. In detail, FIG. 11C shows the displacements at the ultimate limit state on an ascending scale in mm, FIG. 11D shows the stresses at the ultimate limit state on an ascending scale in Mpa and, finally, FIG. 11E shows the deformations at the ultimate limit state, on an ascending scale calculated in VM.

At the conclusion of these tests, the extruded profile was verified, as the deformations showed to be equal to 1.6%<5%.

Figure 12A:
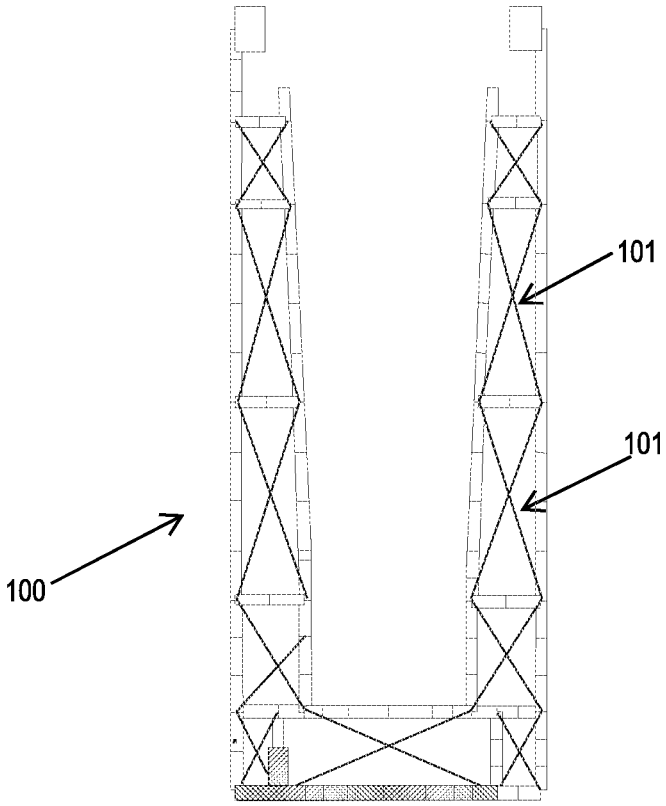
Figure 12B:
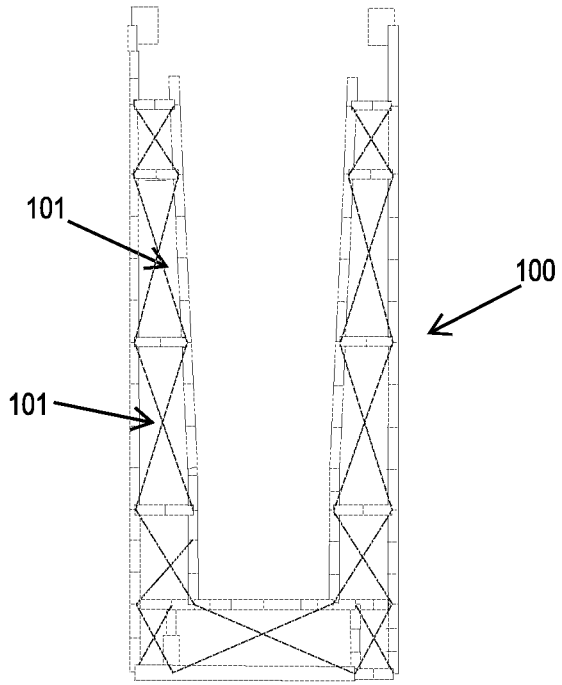

With reference to FIGS. 12A and 12B, the second hypothesis for reinforcing the structure of the device 100 of a traditional type was analysed.

In particular, this solution proposes:

1 Leaving the geometry of the original solution;

2 Introducing expansive premixed cement mortar for anchoring centimetric thicknesses by casting into the holes of the mesh of the device 100.

In detail, the expansive premixed cement mortar for anchoring centimetric thicknesses by casting was considered to have been introduced into all the holes of the device 100 and FIG. 12B schematically illustrates "cross bracings" indicated by the numerical reference 101.

The effect of the expansive premixed cement mortar for anchoring centimetric thicknesses by casting is to create a series of diagonals that work only under compression between the meshes of the extruded profile. The expansive premixed cement mortar for anchoring centimetric thicknesses by casting was thus modelled with diagonal elements of the cutoff bar type only under compression. The cross section of the cutoff bar is dependent on the size of the mesh in the extrusion direction. Considering that the mesh has a size of 10 mm along the extent of the extruded profile, a cutoff bar with a rectangular cross section of 10×4 mm was considered, thus resulting in a cross-section area of 40 $mm^2$ for each equivalent beam element which represents the cutoff bars.

Figure 13A:
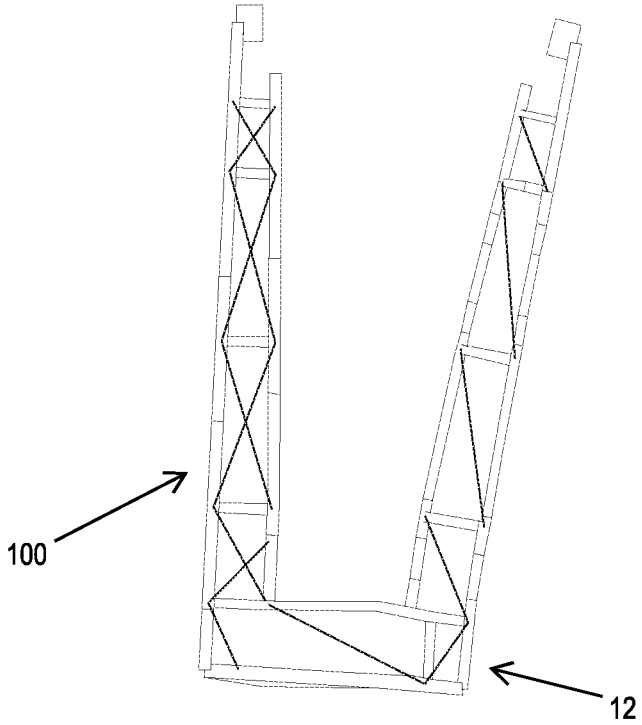
FIGS. 13A-13G represent the schematic results of the displacement of the device in FIGS. 12A-12B to the serviceability limit state and ultimate limit state, with different load multipliers.
Figure 13B:
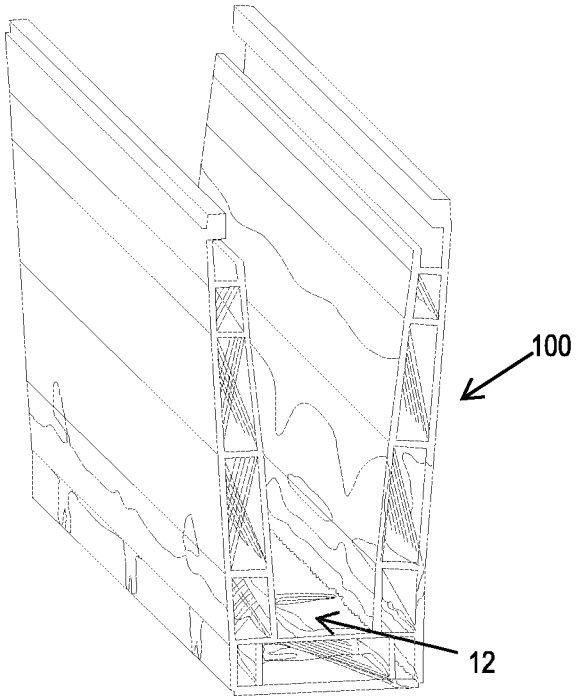

At this point, similarly to what was done for the previous solution, in this case as well, FIGS. 13A-13B show the results of the second solution at the serviceability limit state, with a load multiplier equal to 1. Given that the results showed from the start that the thickness of the walls was insufficient, only an elastic linear analysis was carried out in order not to waste time waiting for a convergence of solutions that would have greatly exceeded the elastic limit.

In FIG. 13A one may see the displacement at the serviceability limit state, represented by an ascending scale of displacement in mm. The solution with diagonals showed to be very rigid for the bracket 11, because a grid-like system is formed. As for the base 12, by contrast, substantial plasticization remains, as may be seen in FIG. 13B, relating to stresses at the serviceability limit state.

FIGS. 13C-13G, on the other hand, show the results at the ultimate limit state with a load multiplier at 1.50.

Figure 13C:
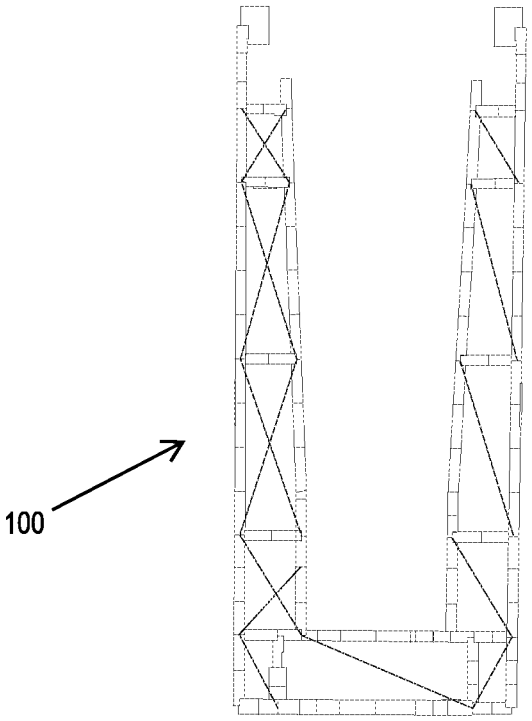
Figure 13D:
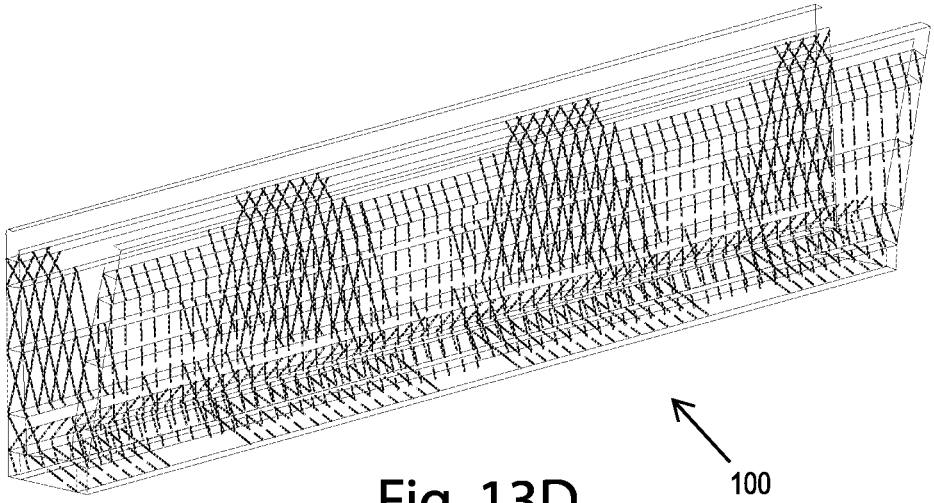

In FIGS. 13C and 13D, one may see the actions on the cutoff bars at the ultimate limit state, again by means of an ascending scale expressed in kN.

Using an expansive premixed cement mortar for anchoring centimetric thicknesses by casting and considering the relevant technical datasheet, there is a compressive strength of:

| | | | |
|---|---|---|---|
| Compressive strength | UNI EN 12190 | at 28 d ≥ 24 MPa | 1 d > 35 MPa<br>7 d > 65 MPa<br>28 d > 75 MPa |

γ=1.5 safety coefficient fck=75 MPa characteristic strength of the expansive premixed cement mortar for anchoring centimetric thicknesses by casting fcd=fck/1.5=50 MPa calculated compressive strength of the expansive premixed cement mortar for anchoring centimetric thicknesses by casting.

Considering a cross section of 10×4 mm (equal to 40 $mm^2$), where 10 mm is the mesh pitch and 4 mm is a geometrically reasonable thickness for the cutoff bar, what results is a maximum strength of:

NRd=50 Mpa×40 $mm^2$=2 kN calculated strength of the compressed cutoff bar

Figure 13E:
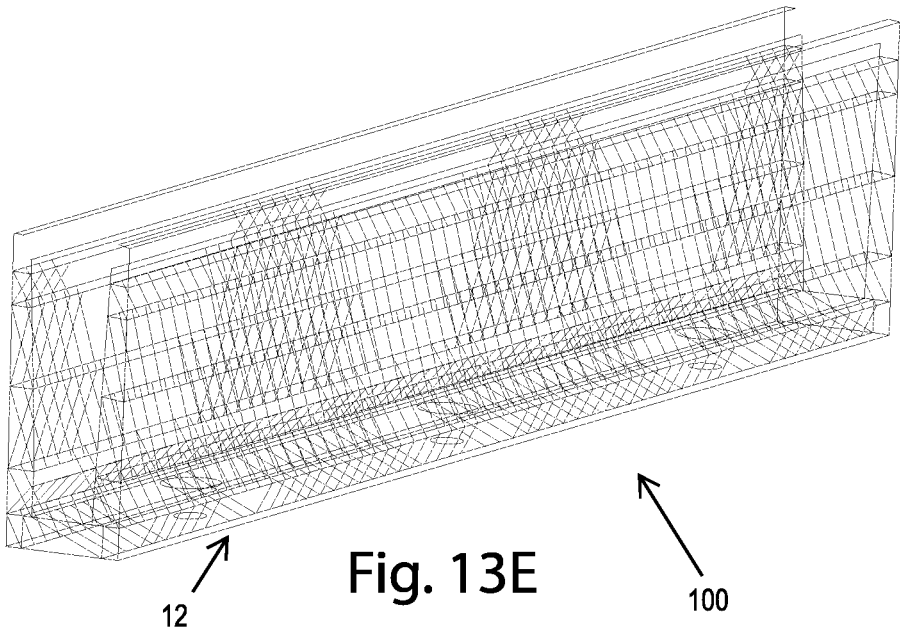

The cutoff bars in white, at the base 12 in FIG. 13E, exceed the calculated strength.

Figure 13F:
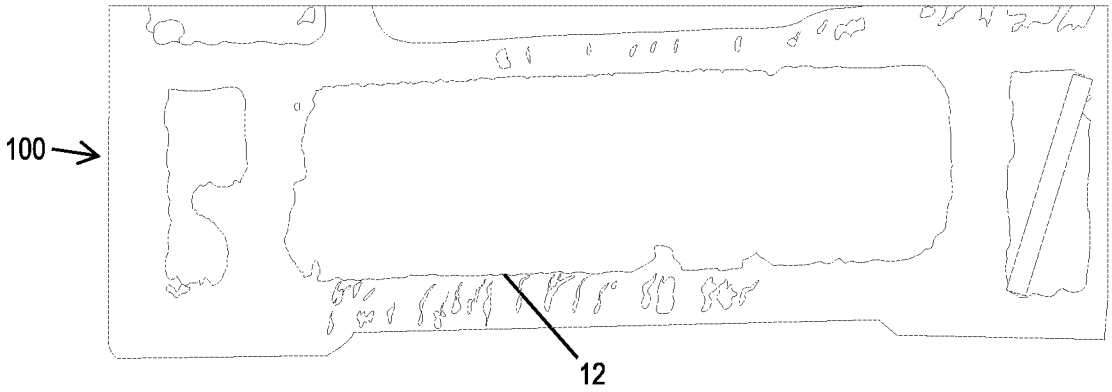

Only in the mesh corner cutoff bars of the base 12, indicated in FIG. 13F, are there stresses exceeding the strength.

A compression-induced crack could form in the direction of the compressed diagonal. Based on a first analysis, however, this is not deemed to be a significant critical aspect, since the material remains in place, retained by the aluminium and protecting the surrounding walls from bending.

Figure 13G:
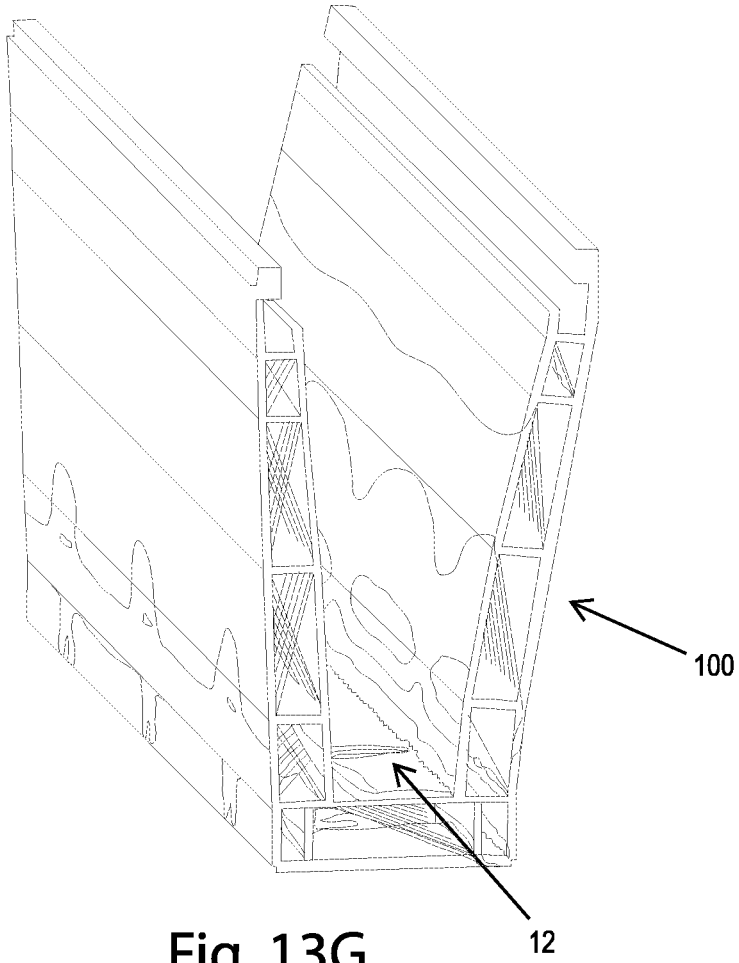

Finally, FIG. 13G shows the stress field in the aluminium profile at the ultimate limit state, again with an ascending scale expressed in Mpa. In these study cases as well, despite the presence of the expansive premixed cement mortar for anchoring centimetric thicknesses by casting, the upper wall of the base 12 shows to be excessively stressed by the internal actions deriving from the upper bracket 11 and poses the same problems as explained for the previous solution.

Figure 14:
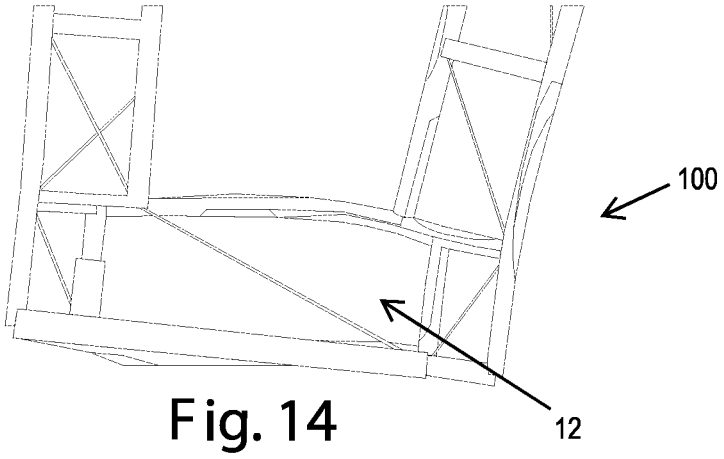
FIG. 14 schematically shows the conclusions of all the studies carried out and described in the preceding figures.
Figure 15:
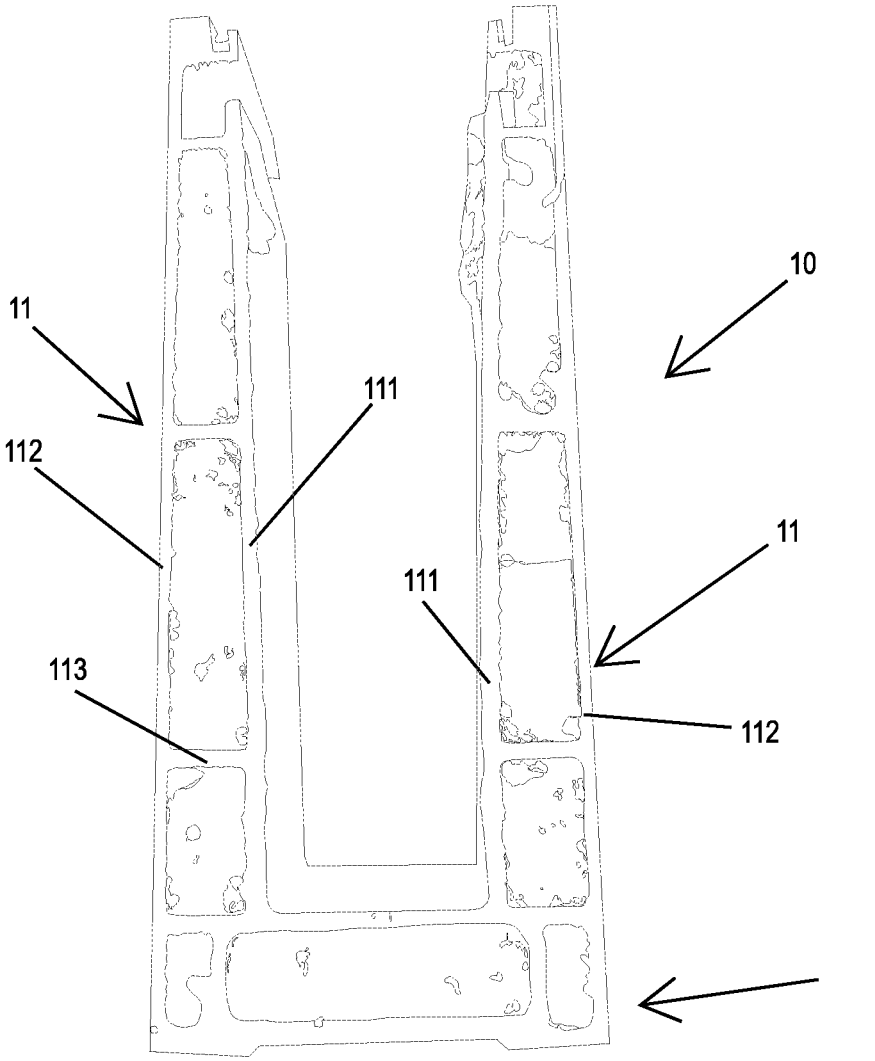
FIG. 15 is a perspective view of the device with an improved structure, according to the present invention.

The conclusions of all these study solutions for optimizing the structure of the device 100 of the prior art are summed up in FIG. 14.

In particular, they lead to an extruded profile that is not verified due to the following critical aspects:

insufficient thickness of the lower part of the base 12;

high compression on the cutoff bars of expansive premixed cement mortar for anchoring centimetric thicknesses by casting;

Lack of an element for taking up the pull of the Viederndeel wall as introduced above.

For this reason, based on all these analyses, the optimised solution previously described in this patent application was arrived at.

This solution, through the results of all the aforesaid study and experimentation phases, not only overcomes the limits of the prior art, but also optimizes the final structure for achieving the previously specified objectives.

From the description provided, the features of the device for clamping panels or sheets, with an improved structure, of the present invention are clear, as are the advantages thereof, both operational and functional.

Finally, it is clear that numerous other variants can be introduced to the clamping device and adjustment in question without going beyond the principles of novelty inherent in the inventive idea, just as it is clear that, in the practical implementation of the invention, the materials, shapes and sizes of the details illustrated may be any whatsoever according to needs and the same may be replaced with other equivalent ones.

The invention claimed is:

1. A device for clamping panels and sheets, comprising an extruded profile, having a U-shaped profile, inferiorly attachable to a reference surface and capable of housing within said U-shaped profile at least one of said panels or sheets, wherein said profile is made of aluminum and comprises:

a first and a second bracket, each comprising a respective inner wall and a respective outer wall adapted to act as upright members; and a plurality of further horizontal inner walls located between said inner wall and said outer wall adapted to act as cross members;

a base box to which said first and second brackets are transversely fixed in a direction exiting from said base box;

a plurality of polygonal shaped slots which are formed within said first and second brackets and said base box;

wherein at least one slot of said plurality of slots in said first and second brackets is filled with an expansive premixed cement mortar for anchoring, so as to create a device of the hybrid type.

2. The device as claimed in claim 1, wherein said slots are quadrangular shaped.

3. Clamping device as claimed in claim 1, wherein said slots are triangular shaped.

4. The device as claimed in claim 1, wherein the entire plurality of said slots is filled with said expansive premixed cement mortar for anchoring.

5. The device as claimed in claim 1, wherein said expansive premixed cement mortar for anchoring is filled into said plurality of slots by means of a casting technique for centimetric thicknesses.

6. The device as claimed in claim 1, wherein the inner walls penetrate perpendicularly into the base box.

7. The device as claimed in claim 6, wherein said base box has a thickness of 3.5 mm.

8. The device as claimed in claim 1, wherein each of said inner wall, said outer wall and said further inner walls are substantially flat.

9. The device as claimed in claim 1, wherein each of said inner wall, said outer wall and said further inner walls comprises knurls and/or protrusions.

* * * * *